United States Patent [19]

Kleinhäny

[11] Patent Number: 4,771,620

[45] Date of Patent: Sep. 20, 1988

[54] LOCKING DEVICE FOR A MECHANICAL-ELECTRONIC LOCKING APPARATUS

[75] Inventor: Arno Kleinhäny, Hinwil, Switzerland

[73] Assignee: Bauer Kaba AG, Wetzikon, Switzerland

[21] Appl. No.: 136,562

[22] Filed: Dec. 22, 1987

Related U.S. Application Data

[63] Continuation-in-part of Ser. No. 921,130, Oct. 21, 1986, abandoned.

[30] Foreign Application Priority Data

Dec. 19, 1985 [CH] Switzerland ..... 5435/85

[51] Int. Cl.[4] ..... E05B 47/00

[52] U.S. Cl. ..... 70/277; 70/358

[58] Field of Search ..... 70/276, 277, 278, 279, 70/280, 281, 282, 283, 358, 364 R, 364 A, 372, 379 R, 380, 421; 292/359; 200/43.05

[56] References Cited

U.S. PATENT DOCUMENTS

| | | | |
|---|---|---|---|
| 3,412,588 | 11/1968 | Schwegler | 70/358 |
| 4,603,564 | 8/1986 | Kleinhäny et al. | 70/277 |
| 4,612,787 | 9/1986 | Prunbauer et al. | 70/358 |
| 4,658,105 | 4/1987 | Seckinger | 200/43.05 |
| 4,686,358 | 8/1987 | Seckinger | 235/382 |

*Primary Examiner*—Robert L. Wolfe

*Attorney, Agent, or Firm*—Walter C. Farley

[57] ABSTRACT

A lock cylinder has a stator rotatably mounted in a lock cylinder casing fixed with respect to the lock, is lockable to said casing and is operatively connectable to the driver on the rotor by means of tumbler pins between rotor and stator. The stator can be locked to the casing by an electromagnetic latch and for rotating the stator together with the rotor, use is made as a blocking catch of the tumbler pins arranged in a selected manner with respect to the shear line therebetween. The locking and unlocking between the locking cylinder casing and the stator is effective if the tumbler pins prevent the relative movement between the rotor and stator.

6 Claims, 4 Drawing Sheets

LOCKING DEVICE FOR A MECHANICAL-ELECTRONIC LOCKING APPARATUS

This is a oontinuation-in-part of U.S. Ser. No. 921,130, filed Oct. 21, 1986, now abandoned.

The present invention is in the security field and relates to a locking device of the type having a rotor and a driver, coupled for rotation together, and a stator surrounding the rotor, the stator and rotor being joined by radially displaceable tumbler pins.

BACKGROUND OF THE INVENTION

On the basis of a lock cylinder according to the prior art (Swiss Patent No. 449,445) and U.S. Pat. No. 3,412,588 with mechanical tumblers, for blocking or freeing the relative movement between rotor and stator, an object of the present invention is to so further develop a lock cylinder of the aforementioned type that it can be operated electronically or mechanically or in combined form in a lock system through an electrically controllable tumbler.

SUMMARY OF THE INVENTION

A mechanical lock cylinder developed for this purpose is rotatable in its entirety as a "rotor", is arranged in a casing fixedly mounted on the lock, is lockable and unlockable relative to said casing and is operatively connectable with the bolt driver in the lock region by means of the tumbler pins between rotor and stator. Preferably the completely rotatable lock cylinder is electromagnetically lockable to the fixed casing surrounding it and the lock cylinder rotor and stator are blocked against relative rotation by the tumbler pins arranged in any selected manner with respect to the shear line, so that the locking between the casing and stator is effective.

The electromagnetically lockable construction has the advantage that the completely lockable mechanical lock cylinder, e.g. electronically, time-controlled, programmed, etc. by means of electromagnetic means, can release the stator/rotor catch in a conventional manner by the flat key coded with rows of depressions or recesses. The associated key can have electronic, electronic and mechanical or only mechanical opening means. Such a lock system offers incomparably extended flexibility of the locking installation over the usual cylinder/key means with which the user is well acquainted and the customary, in part standardized, dimensions of the lock cylinder and driving mechanism known to the lock manufacturer.

BRIEF DESCRIPTION OF THE DRAWINGS

A special embodiment of the invention is now described in greater detail relative to the drawings, wherein:

FIGS. 5, 5A, 5B and 5C are a developed projection, front and back elevations and a partial sectional view, respectively, of an embodiment of a control ring for an electromagnetically releasable locking system.

DESCRIPTION OF THE PREFERRED EMBODIMENT

Figure 1:
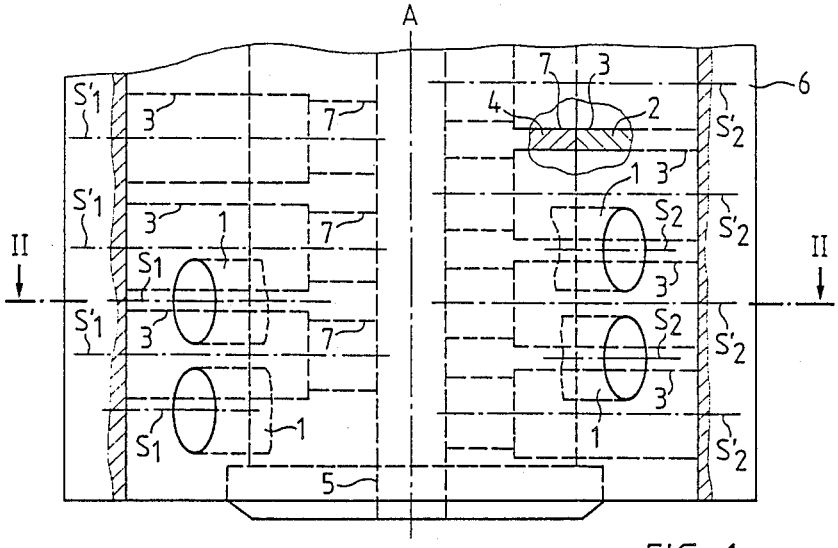
FIG. 1 PRIOR ART
FIGS. 1 and 2 are a partially cutaway plan view and a transverse sectional view of a lock cylinder with rotor and stator according to the prior art of U.S. Pat. No. 3,412,588.

As is known from locking systems with locked cylinders, by turning the key a driver acting on the lock mechanism comes into action and by its turned position determines the closing or opening function of the lock. The rotary movement of the key and therefore the rotor, as well as the driver connected rigidly to the latter and which in turn operates the lock function, generally takes place manually. The cylinder houses the tumbler or catch pins matching the key code and only permits free turning when the tumbler pins are correctly positioned. The correct positioning is a function of the key. The inventive idea comes into effect with respect to the turning of the driver.

If problems are to be avoided through introducing non-standard dimensions in the field of presently substantially standardized locks, then it is necessary to ensure that there are no changes to the function and form of the driver which is in direct operative connection with the standardized lock mechanism and as established by the prior art. This means that the driver must assume the same position relative to the rotor as in a standard lock cylinder. Additional constructional means for assisting, initiating and realizing closing or opening rotations must not be to the detriment of the rotor and driver. According to the inventive principle if, for closing or opening rotation of the rotor, the rotary movement takes place in the usual way, then the stator surrounding said rotor could also be made to rotate and its rotation could be controlled with a locking means, which functions independently of the existing blocking means. Thus, a key can either be provided with a new control element through which independent locking means can be operated or, without additional control elements, the key can merely be used for the locking and unlocking of the mechanical tumblers.

The locking means, like the blocking means, is controlled so as to be movable between two states, on/off. Either the stator can be rotated or not, or the rotor can be rotated or not, or neither of the two can be rotated. A truth table can be in the following form:

| | Rotor | Stator | Function |
|---|---|---|---|
| 1 | OFF | OFF | No rotation possible |
| 2 | OFF | ON | Electronic release |
| 3 | ON | OFF | Mechanical release |
| 4 | ON | ON | Combined release |

OFF in the present case means locked or blocked and ON means unlocked or free. The rotor and stator can be coupled and uncoupled, as can the stator and casing. According to state 1 the rigid coupling is transferred from the casing to the stator and via the tumbler pins to the rotor connected to the driver. This produces a completely blocked state. According to states 2 or 3 one of the two couplings is removed and consequently a given opening state is obtained. Uncoupling takes place on different paths by activating either the electrically operable locking or mechanically operable blocking means. State 4 can be used for special purposes, e.g. for a restricted closing/opening rotation of the mechanical release part for conditioning the lock mechanism with subsequent electronic unlocking of the electrical release part.

Figure 2:
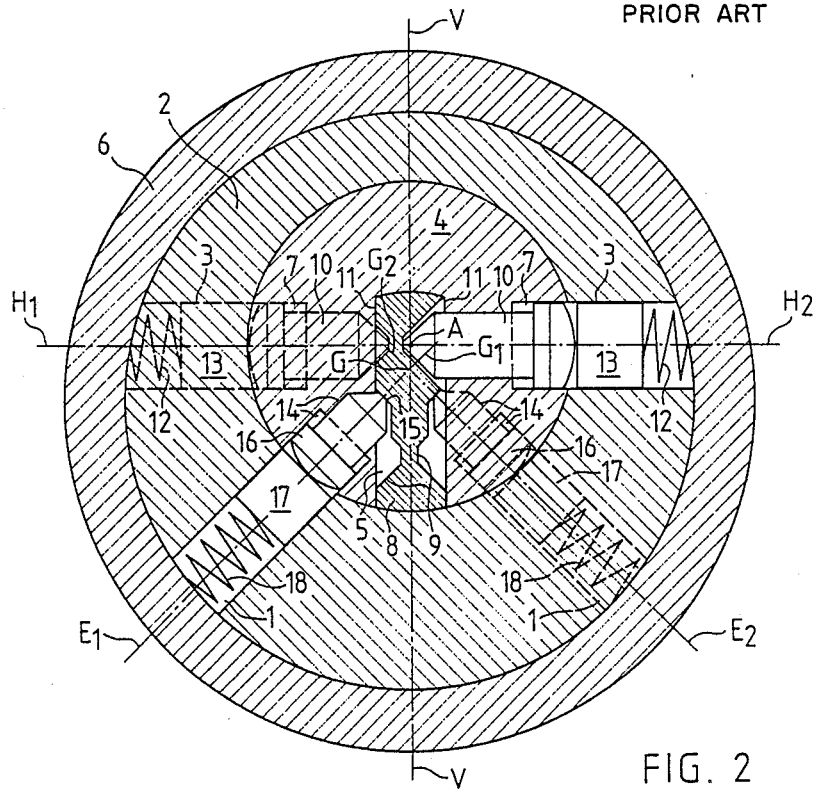
FIG. 2 PRIOR ART

FIGS. 1 and 2 of Swiss Patent No. 449,455 and U.S. Pat. No. 3,412,588 show the blocking between the rotor and stator of the lock cylinder by means of tumbler pins. Of the reference numerals therein, 2 for the stator, 4 for the rotor and 6 for the terminal sleeve have been incorporated into the drawings of the present application. All reference numerals of these two drawings correspond to the description of Swiss Patent No. 449,455, which provides explanations regarding the blocking between rotor and stator.

Figure 3:
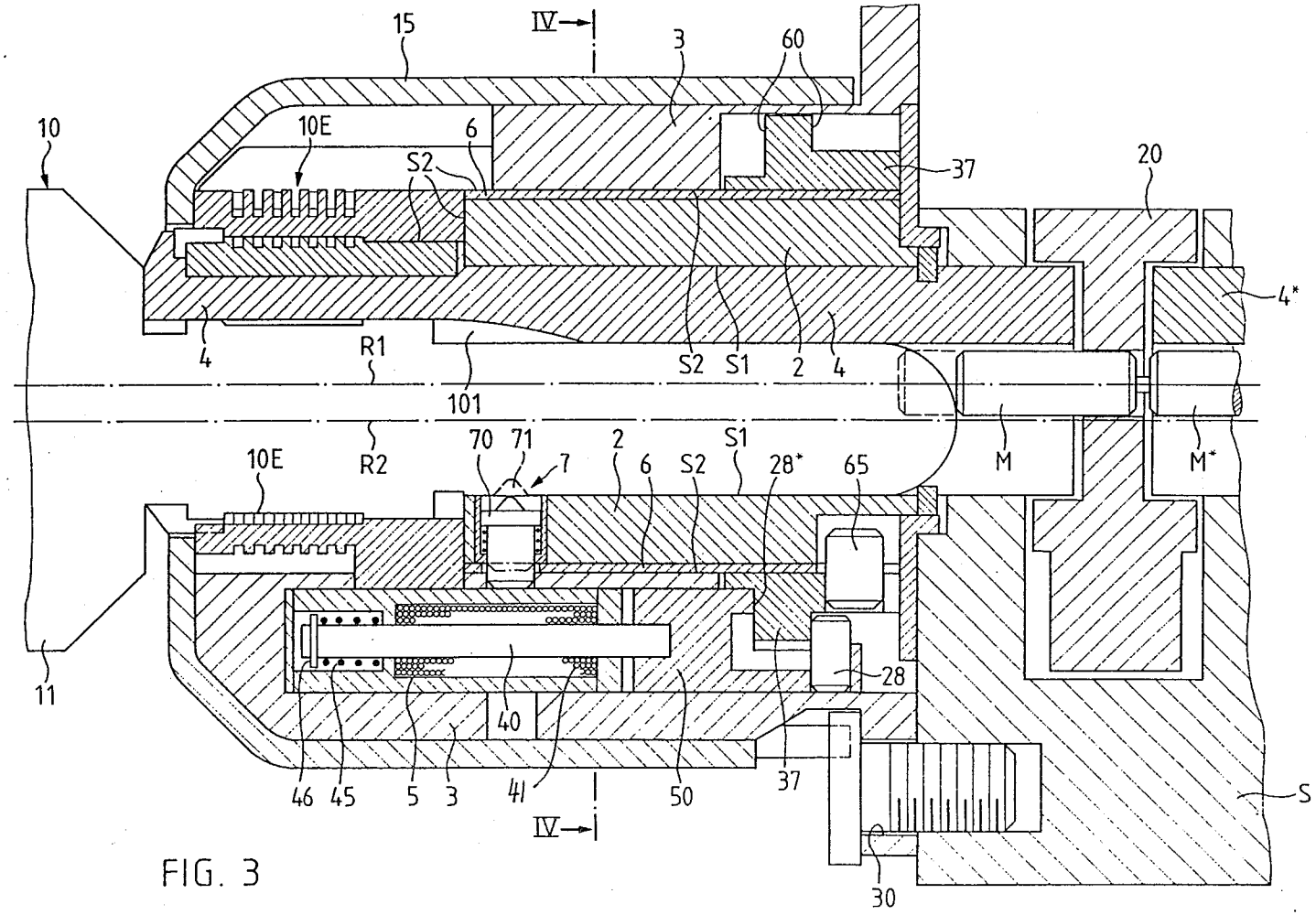
FIG. 3 is a longitudinal section through a lock cylinder according to the invention, with a rotor and a stator rotatable in a cylindrical casing, with locking means, as well as with a flat key in the key channel as the control means.

FIG. 3 shows a longitudinal sectional through a locking device according to a special embodiment of the invention. The section extends from part of the key zone 11, via the locking device and the linked driver part M insertable as a coupling in a recess in driver 20 into the lock region, i.e. along the force action path, through which the torque is transmitted for an opening or closing process. In the presently represented embodiment, the rotary stator is unlocked with the key. Contact means 10E,10F are arranged on the rotor 4 and are arranged along the key slot on a portion of the rotor extended toward the key entrance for electrical tapping purposes. This contact means can be of the type shown in U.S. Pat. No. 4,658,105. However, if no such electrical means 10E,10F and operation with an electronic/-mechanical key are used, then there is no need to extend the rotor beyond the stator length.

The rotor 4 is arranged in a rotatable manner in stator 2 and both contain (not shown) bores with tumbler pins of different lengths (cf. FIGS. 1 and 2), and which, when using the presently provided key, can be so positioned in their depressions with respect to the shear line S1, that the rotor/stator blocking state is removed. Any other hole pattern of the key or the lack of depressions in the key shank, would leave the rotor and stator blocked. A terminal sleeve 6 surrounding stator 2 serves as a support for the tumbler pins, shown in FIG. 4, which are under spring tension in stator 2. This part of the electronic/mechanical locking device essentially corresponds to the mechanical lock cylinder arranged in rotary manner shown in FIGS. 1 and 2.

The terminal sleeve 6 around stator 2 forms a second shear line S2 with the fixed cylinder casing 3, the first shear line S1 being formed by stator 2 and rotor 4. Casing 3 also has a mounting flange with bores 30 for attachment to a web S, which interconnects two lock cylinders, one each for the inside and outside of the door, acting on the same driver part 20. Thus, casing 3 houses a complete lock cylinder with rotor 4, stator 2 and terminal sleeve 6, as a mechanical blocking part, as well as an electromagnetic locking means 5 and/or an additional mechanical locking means 7 with a control part 37 for the electrical operation and/or locking means 11 for the mechanical operation. Casing 3 is finally covered by a cap 15. In the representation according to FIG. 3 only one side of the door is equipped with the electronic/mechanical locking device according to the invention. The rotor 4* with coupling part M* of the counter-cylinder on the other side of the door, which is only partly shown, can be engaged with the common driver 20. Obviously, both door sides can have a locking device according to the invention.

In order to prevent or permit state 4 according to the truth table, an additional control means 70,71 acting on shear line S2 is provided, namely a tumbler pin 70 housed in a bore in stator 2 and which is controllable by means of a recess 71 in key 10, here on the narrow side of the key. In the case of keys which are to function according to state 2 of the truth table, such a recess 71 is present in the key and, with the tumbler pin 70 inserted, shear line S2 can be locked with the aid of the electronic locking means 5 which includes a longitudinally movable armature 40 surrounded by a winding 41 to form an electromagnet or solenoid. Energizing signals for winding 41 are processed in an electronic module which can be conveniently mounted in the door or doorframe. The module can receive signals from a key such as that shown, e.g., in U.S. Pat. No. 4,686,358 through contacts 10E,10F. When winding 41 is energized, armature 40 moves to the right against the force of spring 45, moving components 28 and 50 relative to ring 37. Finally, in the case of keys which are only to operate according to state 3 of the truth table, said recess 71 is not provided and consequently shear line S2 is blocked by tumbler 70, the function of shear line S1 not being influenced. Selectable operating states of the electronic locking means relating to state 2 remain ineffective and the locking device according to the invention can be unlocked in the same way as a conventional mechanical cylinder.

Figure 4:
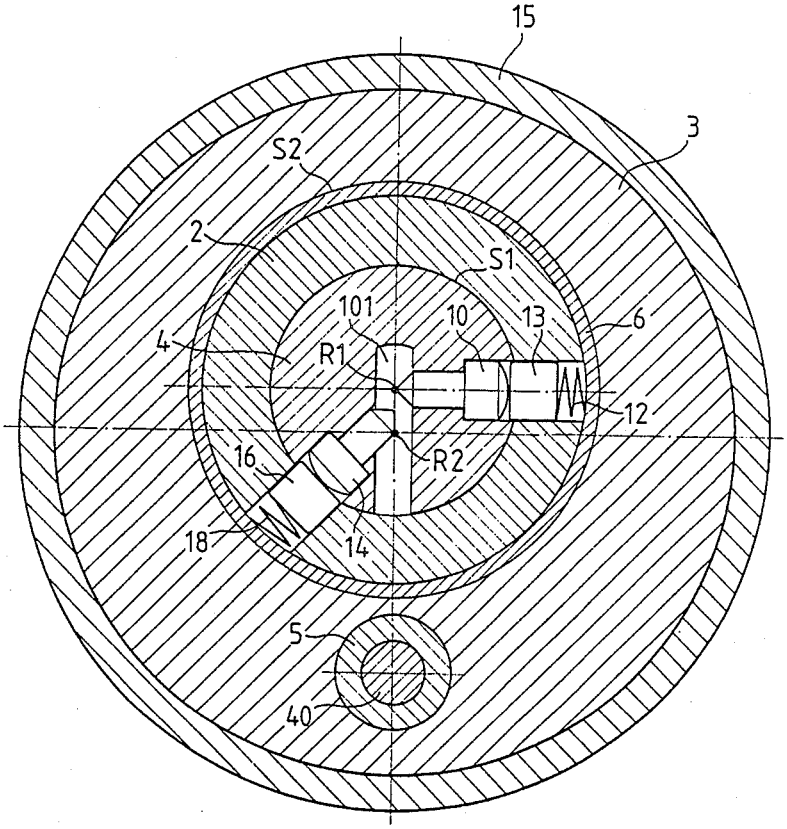
FIG. 4 is a cross-section of FIG. 3 along line IV—IV of FIG. 3.

FIG. 4 shows a cross-section along line IV—IV of FIG. 3 on the just-discussed locking device, but, in a manner similar to FIGS. 1 and 2, is provided with two sets of tumblers 10,13 and 14,16. It is readily possible to see the mechanically lockable part which controls relative motion between rotor 4 and stator 2, which are movable relative to one another along shear line S1. It can be looked upon as a simplified representation of the lock cylinder of FIG. 2, as arranged in the locking device according to FIG. 4. The key channel 101 for receiving key 11 is arranged in rotor 4. A terminal sleeve 6 terminates the tumbler bores with tumbler elements, springs 12, 18, countertumblers 13,16 and core pins 10,14 and simultaneously acts as a basis for shear line S2, along which the complete mechanically lockable part is rotatable in casing 3. In the lower part of casing 3, it is also possible to see the electromagnetic locking means 5. The magnetic armature 40 can be seen. Casing 3 is surrounded by cap 15. R1 and R2 indicate the position of the intersections of rotation axis R1 of the rotor or rotor/stator and rotation axis R2 of the key.

The electromagnetic locking means can be constructed in the following way. A sensing head or probe 50 (FIG. 3) with sensing means 28,28*, here in the form of a sliding pin 28 and a sliding edge or side 28*, engages with a control part 37, which in the represented embodiment is a ring mounted or shaped onto the circumference of stator 2 and having a web-like rotatably sliding link 60. In the lower part of the drawing it is shown how elements of the sensing head 28,28* engage this web-like sliding link 60 and are controlled by the control elements, such as cams and depressions shaped into the sliding link. Sliding link 60 in this case has blocking edges or sides 63 (cf. FIGS. 5 and 5A–5C), on which can be engaged the sliding edge or side 28*, i.e.e. a rotation of driver M through an angle, which allows the lock to open or close, is dependent on the position of sensing means 28* with respect to the blocking edge 63. The desired function can on the one hand be controlled by the hole pattern on the key and on the other by the electromagnetic locking means 5, in this case constituted by a pull magnet with armature 40.

Figure 5:
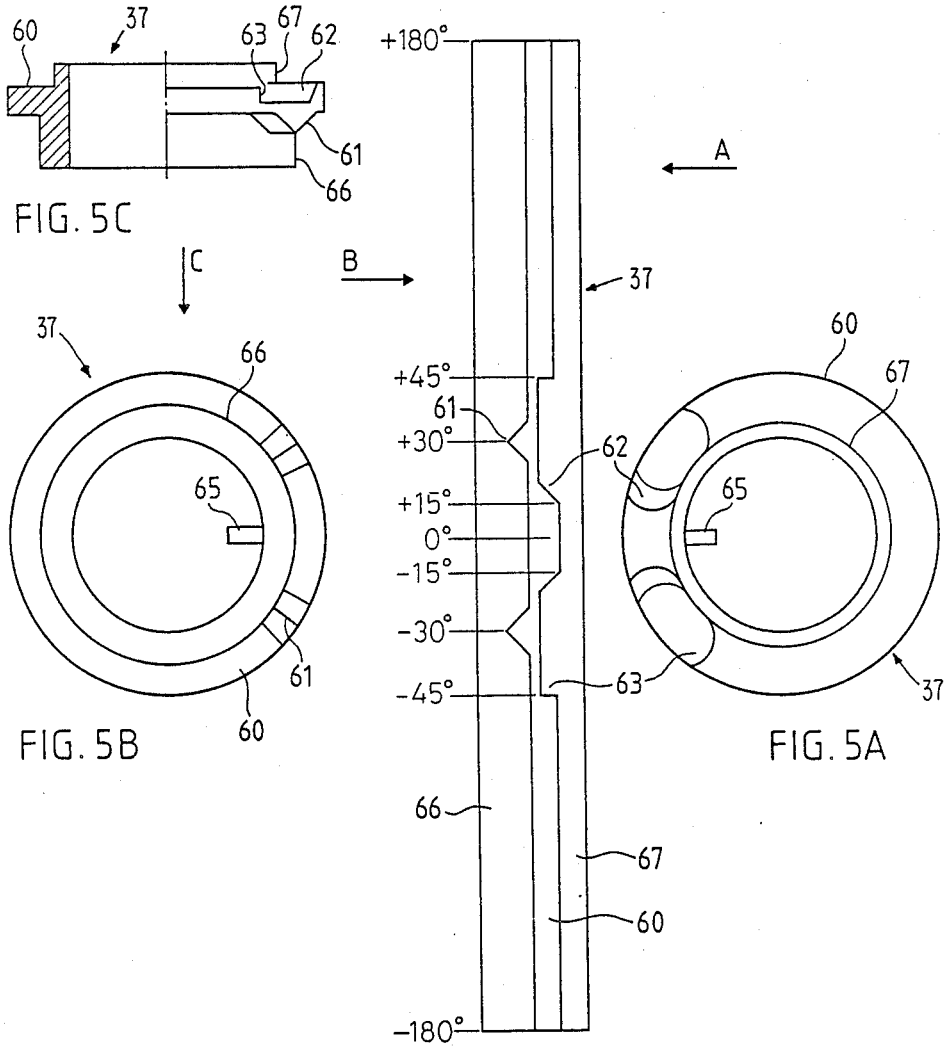

FIGS. 5 and 5A–5C shows an example of a control part 37 in three viewing directions, as well as a developed projection showing the control link 60. The neutral or rest position of the inner lock cylinder before opening or closing on the slide is at 0°. A rotation toward +180°, e.g., causes closing of the lock and rotation in the direction −180 opening of the lock. Both functions are equivalent, so that the link is symmetrically constructed relative to the zero position. If the pull magnet is or becomes currentless or dead, then the sensing head 50 is pressed by the tension of a spring 45 against a link wall, the spring being supported on a clamping ring 46 on armature 40. A rotation of stator 2 and the rotor 4 blocked therewith, i.e. the complete mechanically lockable cylinder part 1,2, after roughly 15° causes axial dislocation of sensing head 50, because its sliding edge 28* first runs into the depression and then by sliding pin 28 running up onto the control cam 61 on the opposite side of the link, the armature 40 is deflected to such an extent that any exciting pulse at the coil terminals in ineffective. Following a roughly 45° rotation in the same direction, there is a blocking against one of the blocking edges 63. The now completed ⅛ rotation is not sufficient for operating the lock. In the case of a permanently live electromagnet, the control cams 61 located on the left-hand side of the link, as seen in FIG. 5, would bring about a blocking action. In order to release a functionally effective rotation, it is necessary to have an exciting pulse of given length, whose length varies as a function of the link construction, or it is possible to choose two or several timesucceeding pulses if additional blocking edges are provided on the link.

The web-like construction of the link is shown in FIG. 5C. The control web of sliding link 60 is so constructed that it keeps the scanning head in the "open or closed position" over most of its length. The control web also has further control elements in the form of cams 61 and depressions with edges 62,63 making it possible to perform ON/OFF functions and authorization limitations in connection with time-dependent exciting pulse lengths. FIG. 5A shows the link with two "depressions" arranged in mirror-symmetrical manner relative to the zero position and whose blocking edges 63 and entry edges 62 are seen in the direction of arrow A. FIG. 5B shows the control link with the two blocking or control cams 61 from B. In both cases there is a fixing pin 65 (cf. also FIG. 3), enabling the control part 37, constructed as a link ring, to be fixed in non-turning manner to the mechanical rotor/stator locking part. Thus, a complex closing/opening condition can be superimposed on a lock cylinder. Thus, for lock operation, it is possible to use a flat key with depressions associated with the cylinder and with which the rotor is merely released, or it is possible to use a key equipped with electrical means, which brings about the complex unlocking between stator and casing, or finally the unlocking between stator and casing can be remotely initiated, the key then constituting control means for tumbler pins 70, which can also block and release the shear line S2.

What is claimed is:

1. A locking device comprising a rotor and a driver coupled together for rotational movement as a unit, said rotor having a slot to receive a key;

a stator surrounding said rotor;

tumbler pins located between said rotor and said stator, said pins being displaceable in radial bores by said key to selectably lock together or release said rotor and stator;

a fixedly mounted lock cylinder casing, said cylindrical stator being rotatable about its own rotation axis in said casing; and electromagnetic locking means for providing electrically releasable locking of said stator to said casing, so that said tumbler pins provide a mechanically releasable connection between said stator and said rotor and said electromagnetic locking means provides an electrically releasable connection between said stator and said casing in response to voltages applied thereto.

2. A locking device according to claim 1, wherein said electromagnetic locking means is fixedly mounted in the lock cylinder casing, said device further including a control part engageable with the locking means on said stator.

3. A locking device according to claim 1, wherein said stator contains a locking means displaceable by means of a control part crossing the shear line between the stator and lock cylinder casing, said locking means having at least one bore radially aligned with respect to the locking means.

4. A locking device according to claim 2, wherein said locking means includes an electromagnet with an armature and a sensing head mounted thereon and said control part includes a sliding link on the circumference of said stator and movable therewith, said link having control elements movable to blocking positions.

5. A locking device according to claim 4, wherein a further locking means is provided in the stator and includes a bore aligned therewith in the lock cylinder casing.

6. A lock cylinder according to claim 5, wherein said further locking means is a tumbler pin arranged in a bore in the stator and insertable into an aligned bore in the lock cylinder casing, said key having a depression to receive said tumbler pin.

* * * * *